US007515721B2

(12) United States Patent
Tashev et al.

(10) Patent No.: US 7,515,721 B2
(45) Date of Patent: Apr. 7, 2009

(54) SELF-DESCRIPTIVE MICROPHONE ARRAY

(75) Inventors: Ivan Tashev, Kirkland, WA (US); Henrique S. Malvar, Sammamish, WA (US); Ross Cutler, Duvall, WA (US); Daniel J. Sisolak, Issaquah, WA (US); John E. Unverferth, III, Kirkland, WA (US)

(73) Assignee: Microsoft Corporation, Redmond, WA (US)

( * ) Notice: Subject to any disclaimer, the term of this patent is extended or adjusted under 35 U.S.C. 154(b) by 815 days.

(21) Appl. No.: 10/775,371

(22) Filed: Feb. 9, 2004

(65) Prior Publication Data

US 2005/0175190 A1 Aug. 11, 2005

(51) Int. Cl.
*H04R 3/00* (2006.01)

(52) U.S. Cl. ..... 381/92

(58) Field of Classification Search ..... 381/58, 381/56, 92, 111–115, 122, 120, 60, 175; 704/234

See application file for complete search history.

(56) References Cited

U.S. PATENT DOCUMENTS

| | | | | |
|---|---|---|---|---|
| 6,032,115 | A * | 2/2000 | Kanazawa et al. | 704/234 |
| 6,487,574 | B1 | 11/2002 | Malvar | |
| 6,496,795 | B1 | 12/2002 | Malvar | |
| 6,954,535 | B1 * | 10/2005 | Arndt et al. | 381/60 |
| 2004/0202333 | A1 * | 10/2004 | Csermak et al. | 381/60 |
| 2005/0254673 | A1 * | 11/2005 | Hsieh et al. | 381/175 |

OTHER PUBLICATIONS

S. Nordholm, I. Claesson, M. Dahl. "Adaptive microphone array employing calibration signals; an analytical evaluation". IEEE Trans. on Speech and Audio Processing, vol. 7, pp. 241-252, May 1999.

D. A. Florêncio and H. S. Malvar, "Multichannel filtering for optimum noise reduction in microphone arrays," Proc. International Conference on Acoustic, Speech, and Signal Processing, pp. 197-200, May 2001.

M. Seltzer, B. Raj. "Calibration of Microphone arrays for improved speech recognition". Mitsubishi Research Laboratories Technical Report, TR-2001-43, Dec. 2001.

H. Teutsch and G. Elko. "An adaptive close-talking microphone array," Proc. IEEE Workshop on Applications of Signal Processing to Audio and Acoustics, pp. 163-166, Oct. 2001.

(Continued)

*Primary Examiner*—Ping Lee
(74) *Attorney, Agent, or Firm*—Lyon & Harr, LLP; Mark A. Watson

(57) ABSTRACT

A self-descriptive microphone array includes a microphone array memory, such as, for example a ROM, EEPROM, or other conventional memory, which contains a microphone array device description. This device description includes parametric information which defines operational characteristics and configuration of the microphone array. In further embodiments, the microphone array uses any of a variety of conventional wired or wireless computer interfaces, including serial, IEEE 1394, USB, Bluetooth™, etc., to connect to a computing device. Once connected, the microphone array provides its device description to the computing device. Sound processing software residing within the computing device is then automatically configured for optimally interacting with one or more analog or digital audio signals provided by the microphone array. In another embodiment, the microphone array performs integrated self calibration for automatically updating the device description. The self calibration is performed either upon connection to the computing device, or upon regular or user-specified intervals.

30 Claims, 4 Drawing Sheets

OTHER PUBLICATIONS

H. Wang and P. Chu, "Voice source localization for automatic camera pointing system in videoconferencing," Proc. International Conference on Acoustic, Speech, and Signal Processing, pp. 187-190, Apr. 1997.

R. Duraiswami, D. Zotkin, and L. S. Davis, "Active speech source localization by a dual coarse-to-fine search," Proc. International Conference on Acoustic, Speech, and Signal Processing, pp. 3309-3312, May 2001.

Selection of Panasonic Microphones, http://www.panasonic.com/industrial/components/rec_mic.htm, as retrieved on Oct. 5, 2005.

Andrea Electronics Desktop Array DA-4000 2.0, http://www.hellodirect.com/supportpages/8000/8010VoiceArray.pdf.

AcousticMagic Voice Tracker, http://www.andreaelectronics.com/pdf_files/ProductSpecs/DA400Spec.pdf.

Andrea Superbeam® Array Microphone: Enabling The Freedom of Voice, Andrea Electronics Corporation, www.andreaelectronics.com, 2002.

* cited by examiner

SELF-DESCRIPTIVE MICROPHONE ARRAY

BACKGROUND

1. Technical Field

The invention is related to a microphone array having one or more microphones in a predetermined arrangement, and in particular, to a self-descriptive microphone array that automatically self-calibrates and provides a current configuration and state to a computer to which it is connected, so that the computer can automatically configure audio processing software to be used for processing audio signals captured via the microphone array.

2. Related Art

Conventional microphone array type devices are well known to those skilled in the art. In general, microphone arrays typically include an arrangement of microphones in some predetermined layout. These microphones are generally used to capture sounds from various directions and originating from different points in space. Once captured, onboard sound processing software and hardware then provides sound processing capabilities, such as, for example, sound source localization, beam forming, acoustic echo cancellation, noise suppression, etc.

For example, one common use for such arrays involving audio conferencing systems is to determine the direction of a dominant speaker in a room having both active speech and other noise, and then to process the input from the various microphones in the array accordingly. In particular, given the input from each of the microphones in the array, conventional beam forming and sound source localization computations are used to localize the position and direction of the person currently speaking. With this information, it is then possible to filter out all sounds not coming from the direction of the speaker, thereby improving the overall quality of the captured sound with respect to the person speaking.

Further, many microphone arrays do adaptive beamforming processing within the array itself. However, acoustic echo cancellation (AEC) processing needs to be tightly coupled to any associated adaptive beamforming processing in order to work properly. Consequently, when external software applications attempt to provide AEC processing in a remote computing device, such as a PC-type computer, while performing beamforming computations within the microphone array itself, the AEC typically fails, or provides sub-optimal results. Therefore, such arrays must typically include additional onboard processing capabilities, thereby increasing array expense, in order to perform adaptive beamforming processing in combination with AEC processing.

As noted above, such microphone arrays typically include onboard processing hardware and software within the microphone array itself for performing analog and/or digital sound processing. Unfortunately, such onboard hardware tends to be significantly more expensive than the actual microphones in the array. Further, because the hardware and software is typically included within the array, updating the hardware and software is often difficult or impossible for an end-user of the equipment.

In addition, every microphone, and thus every microphone within a microphone array, tends to have slightly unique properties with respect to parameters, such as, for example, sensitivity, frequency response, transient response, and directivity vs. frequency. This is typically true even of microphones of the same model or type. Therefore, software for interfacing with microphone arrays is typically specially designed to operate with particular microphone arrays, or includes DLL's or drivers specifically tailored to particular microphone arrays that rely on external computers for audio processing.

For example, with microphone arrays that include onboard processing capabilities, the manufacturer typically knows the exact parameters, i.e., frequency response curves, etc. of the microphones in the array, and simply designs or modifies the software to suit the particular configuration of each specific array. Similarly, with passive microphone arrays that rely on an external computer for sound processing capabilities, the manufacturer of the microphone array typically provides software DLL's or drivers which reside on the computer to which the microphone array is coupled, and which are designed or modified to suit the particular known configuration of the array.

Unfortunately, where the parameters of the array are either not known by the user, or where a user desires to use a particular microphone array with software that was not specifically designed to operate with the particular microphone array, generic software drivers or DLL's operating on an external computer for processing audio inputs from the microphone array tend to produce sub-optimal audio processing results.

Further, the operational parameters of individual microphones in a microphone array tend to change, if even only slightly, over time. Therefore, software tailored to a particular microphone array configuration can produce sub-optimal audio processing results as the parameters of the microphone array change over time.

Therefore, what is needed is a microphone array that avoids the expense of onboard audio processing by acting as an inexpensive peripheral device and using the computational power of an external computer to which it is connected for processing audio signals. Further, rather than requiring software to be specifically pre-tailored to the particular operational parameters of the microphone array, the microphone array should instead be operable with software that automatically configures itself to the operational parameters of the microphone array. Consequently, the microphone array should include the capability to automatically report those operational parameters to the external computer to allow for automatic configuration and optimization of audio processing software residing on that computer.

SUMMARY

A self-descriptive microphone array, as described herein, includes an array of one or more microphones arranged in a predetermined pattern for capturing sounds. This self-descriptive microphone array operates to solve the problems identified above by providing a microphone array memory that is integral to the microphone array. The microphone array memory includes any type of conventional non-volatile memory, such as, for example a ROM, PROM, EPROM, EEPROM, or other conventional memory type or device, which contains a microphone array device description. This device description includes parametric information which defines operational characteristics and configuration of the self-descriptive microphone array. In operation, the device description of the self-descriptive microphone array is automatically reported to an external computing device via a microphone array interface to allow for automatic configuration of audio processing software residing within the external computing device.

As noted above, the microphone array device description is automatically provided to an external computing device, such as a PC-type computer, or other computing device to which the microphone array is connected. The external computing device then uses the device description to automatically configure audio processing software for processing one or more audio signals captured by the self-descriptive microphone array. Specifically, software drivers on the external computing device, such as DLL's or other software drivers, interpret physical parameters of the self-descriptive microphone array that are provided by the microphone array device description. These software drivers then communicate the physical parameter data of the self-descriptive microphone array to signal processing software residing within the external computing device. This allows the signal processing software to automatically adjust its parameters to the characteristics of the attached microphone array to perform automatically optimized audio processing computations.

Consequently, because the self-descriptive microphone array makes use of external computing power, rather than including onboard audio processing hardware and software, the self-descriptive microphone array is relatively inexpensive to manufacture in comparison to conventional microphone array devices that include onboard audio processing capabilities. Further, because external processing power is used for audio processing, combined applications such as, for example, adaptive beamforming combined with acoustic echo cancellation (AEC) can be easily performed without including expensive audio processing software and/or hardware within the array itself. Consequently, one major advantage of moving microphone array audio processing to an external computing device is that it enables conventional conferencing applications, applications, such as, for example Microsoft® Windows® Messenger, or other real-time messaging applications, to use microphone arrays such as the self-descriptive microphone array described herein while significantly reducing microphone array costs.

The connection between the self-descriptive microphone array and the external computing device is accomplished using any of a variety of conventional wired or wireless computer interfaces, including, for example, serial, IEEE 1394, USB, IEEE 802.11, Bluetooth™, etc., to connect to the external computing device. As noted above, once connected, the self-descriptive microphone array provides its device description to the external computing device which then automatically configures audio processing software residing within the computing device for optimally processing one or more analog or digital audio signals provided by the self-descriptive microphone array.

Further, as is well known to those skilled in the art, individual microphone operational characteristics, as well as the characteristics of most other electrical components, tend to change over time, and as a function of local temperature. Consequently, in one embodiment, the self-descriptive microphone array includes an integral self-calibration system for automatically determining or evaluating at least some of the operational parameters of the microphones and associated preamplifiers comprising the self-descriptive microphone array. The microphone array device description within the microphone array memory is then automatically updated to reflect actual configuration of the self-descriptive microphone array.

For example, in one embodiment, the integral self-calibration system is capable of automatically determining one or more of the sensitivity and gain (i.e., magnitude and phase gains) of the individual channels (microphone plus preamplifier) of the individual channels (microphone plus preamplifier) in the self-descriptive microphone array. In alternate embodiments, the integral self-calibration system of the self-descriptive microphone array operates automatically either upon connection to the computing device, upon regular or user-specified intervals, or upon command.

As noted above, preamplifiers are associated with each microphone in the self-descriptive microphone array. Further, to allow for multiple simultaneous channels of audio to be captured by the self-descriptive microphone array, one or analog-to-digital (A/D) converters are also associated with each microphone. Audio signals captured by the microphone array are then pre-amplified (i.e., gain) and converted to a digital signal via the A/D converters and provided, via the aforementioned wired or wireless computer interface, to the audio processing software residing within the external computing device for further processing, as desired. The maximum number of digital audio channels that can then be transmitted via the computer interface is then only limited by the maximum bandwidth of that computer interface in combination with the digital sampling rate of each channel of the microphone array.

In another embodiment, in addition to including one or more microphones, the self-descriptive microphone array also includes one or more speakers for reproducing one or more audio signals. For example, many microphone arrays, such as those arrays used for audio conferencing, frequently include both microphones and speakers. The microphones capture sound, and the speakers play back sound. Generally, conventional audio conferencing-type microphone arrays also include relatively expensive onboard acoustic echo cancellation capabilities so that local audio signals are not endlessly echoed during an audio conference. However, in the context of the self-descriptive microphone array, audio processing, such as acoustic echo cancellation, is performed via the audio processing software residing within the external computing device. Audio to be played back via the self-descriptive microphone array is then simply transmitted from the external computing device to the array via the aforementioned wired or wireless computer interface.

As with the parametric information defining the microphones within the self-descriptive microphone array, parametric information defining the speakers within the self-descriptive microphone array is also stored within the microphone array memory. Configuration of the microphones and the speakers within the microphone array are then reported, as noted above, to allow for automatic configuration of the audio processing software residing within the external computing device to which the self-descriptive microphone array is connected.

In view of the above summary, it is clear that the self-descriptive microphone array provides a unique system and method for automatically reporting microphone array device configuration to an external computing device for automatic optimization of audio processing software. In addition to the just described benefits, other advantages of the self-descriptive microphone array will become apparent from the detailed description which follows hereinafter when taken in conjunction with the accompanying drawing figures.

DESCRIPTION OF THE DRAWINGS

The specific features, aspects, and advantages of the present invention will become better understood with regard to the following description, appended claims, and accompanying drawings where:

DETAILED DESCRIPTION OF THE PREFERRED EMBODIMENTS

In the following description of the preferred embodiments of the present invention, reference is made to the accompanying drawings, which form a part hereof, and in which is shown by way of illustration specific embodiments in which the invention may be practiced. It is understood that other embodiments may be utilized and structural changes may be made without departing from the scope of the present invention.

Figure 1:
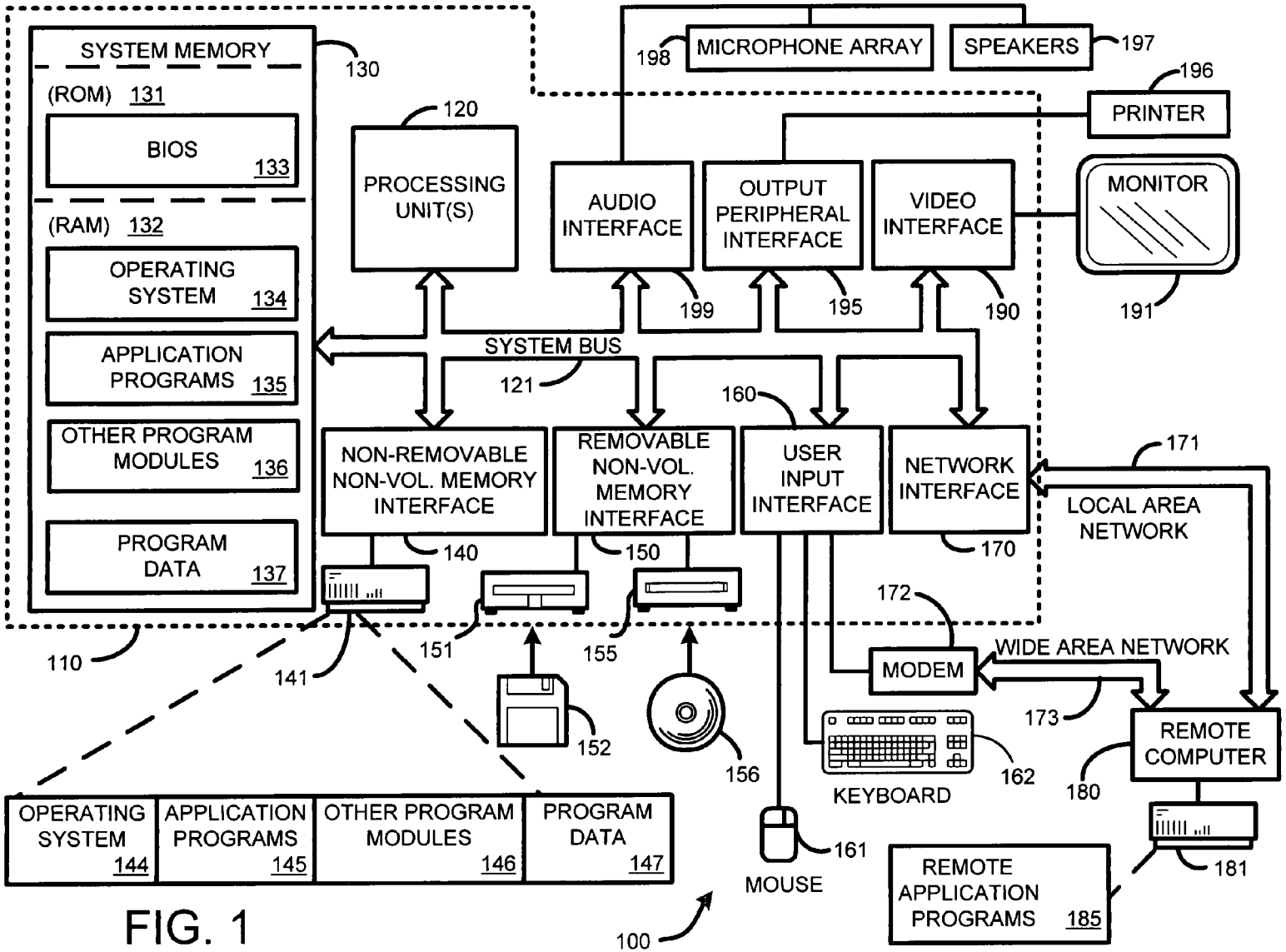
FIG. 1 is a general system diagram depicting a general-purpose computing device constituting an exemplary system for interfacing with a self-descriptive microphone array.

1.0 Exemplary Operating Environment:

FIG. 1 illustrates an example of a suitable computing system environment 100 on which the invention may be implemented. The computing system environment 100 is only one example of a suitable computing environment and is not intended to suggest any limitation as to the scope of use or functionality of the invention. Neither should the computing environment 100 be interpreted as having any dependency or requirement relating to any one or combination of components illustrated in the exemplary operating environment 100.

The invention is operational with numerous other general purpose or special purpose computing system environments or configurations. Examples of well known computing systems, environments, and/or configurations that may be suitable for use with the invention include, but are not limited to, personal computers, server computers, hand-held, laptop or mobile computer or communications devices such as cell phones and PDA's, multiprocessor systems, microprocessor-based systems, set top boxes, programmable consumer electronics, network PCs, minicomputers, mainframe computers, distributed computing environments that include any of the above systems or devices, and the like.

The invention may be described in the general context of computer-executable instructions, such as program modules, being executed by a computer in combination with hardware modules, including components of a microphone array 198. Generally, program modules include routines, programs, objects, components, data structures, etc., that perform particular tasks or implement particular abstract data types. The invention may also be practiced in distributed computing environments where tasks are performed by remote processing devices that are linked through a communications network. In a distributed computing environment, program modules may be located in both local and remote computer storage media including memory storage devices. With reference to FIG. 1, an exemplary system for implementing the invention includes a general-purpose computing device in the form of a computer 110.

Components of computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 110 typically includes a variety of computer readable media. Computer readable media can be any available media that can be accessed by computer 110 and includes both volatile and nonvolatile media, removable and non-removable media. By way of example, and not limitation, computer readable media may comprise computer storage media and communication media. Computer storage media includes volatile and nonvolatile removable and non-removable media implemented in any method or technology for storage of information such as computer readable instructions, data structures, program modules, or other data.

Computer storage media includes, but is not limited to, RAM, ROM, PROM, EPROM, EEPROM, flash memory, or other memory technology; CD-ROM, digital versatile disks (DVD), or other optical disk storage; magnetic cassettes, magnetic tape, magnetic disk storage, or other magnetic storage devices; or any other medium which can be used to store the desired information and which can be accessed by computer 110. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared, and other wireless media. Combinations of any of the above should also be included within the scope of computer readable media.

The system memory 130 includes computer storage media in the form of volatile and/or nonvolatile memory such as read only memory (ROM) 131 and random access memory (RAM) 132. A basic input/output system 133 (BIOS), containing the basic routines that help to transfer information between elements within computer 110, such as during start-up, is typically stored in ROM 131. RAM 132 typically contains data and/or program modules that are immediately accessible to and/or presently being operated on by processing unit 120. By way of example, and not limitation, FIG. 1 illustrates operating system 134, application programs 135, other program modules 136, and program data 137.

The computer 110 may also include other removable/non-removable, volatile/nonvolatile computer storage media. By way of example only, FIG. 1 illustrates a hard disk drive 141 that reads from or writes to non-removable, nonvolatile magnetic media, a magnetic disk drive 151 that reads from or writes to a removable, nonvolatile magnetic disk 152, and an optical disk drive 155 that reads from or writes to a removable, nonvolatile optical disk 156 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 141 is typically connected to the system bus 121 through a non-removable memory interface such as interface 140, and magnetic disk drive 151 and optical disk drive 155 are typically connected to the system bus 121 by a removable memory interface, such as interface 150.

The drives and their associated computer storage media discussed above and illustrated in FIG. 1, provide storage of computer readable instructions, data structures, program modules and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136, and program data 137. Operating system 144, application programs 145, other program modules 146, and program data 147 are given different numbers here to illustrate that, at a minimum, they are different copies. A user may enter commands and information into the computer 110 through input devices such as a keyboard 162 and pointing device 161, commonly referred to as a mouse, trackball, or touch pad.

Other input devices (not shown) may include a joystick, game pad, satellite dish, scanner, radio receiver, and a television or broadcast video receiver, or the like. These and other input devices are often connected to the processing unit 120 through a wired or wireless user input interface 160 that is coupled to the system bus 121, but may be connected by other conventional interface and bus structures, such as, for example, a parallel port, a game port, a universal serial bus (USB), an IEEE 1394 interface, a Bluetooth™ wireless interface, an IEEE 802.11 wireless interface, etc. Further, the computer 110 may also include a speech or audio input device, such as a microphone or a microphone array 198, as well as a loudspeaker 197 or other sound output device connected via an audio interface 199, again including conventional wired or wireless interfaces, such as, for example, parallel, serial, USB, IEEE 1394, Bluetooth™, etc.

A monitor 191 or other type of display device is also connected to the system bus 121 via an interface, such as a video interface 190. In addition to the monitor, computers may also include other peripheral output devices such as a printer 196, which may be connected through an output peripheral interface 195.

The computer 110 may operate in a networked environment using logical connections to one or more remote computers, such as a remote computer 180. The remote computer 180 may be a personal computer, a server, a router, a network PC, a peer device, or other common network node, and typically includes many or all of the elements described above relative to the computer 110, although only a memory storage device 181 has been illustrated in FIG. 1. The logical connections depicted in FIG. 1 include a local area network (LAN) 171 and a wide area network (WAN) 173, but may also include other networks. Such networking environments are commonplace in offices, enterprise-wide computer networks, intranets, and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the user input interface 160, or other appropriate mechanism. In a networked environment, program modules depicted relative to the computer 110, or portions thereof, may be stored in the remote memory storage device. By way of example, and not limitation, FIG. 1 illustrates remote application programs 185 as residing on memory device 181. It will be appreciated that the network connections shown are exemplary and other means of establishing a communications link between the computers may be used.

The exemplary operating environment having now been discussed, the remaining part of this description will be devoted to a discussion of the program modules and processes embodying a "self-descriptive microphone array" which automatically provides configuration information describing physical parameters of the microphone array to an external computing device for automatic configuration of audio processing software and/or hardware.

2.0 Introduction:

A self-descriptive microphone array, as described herein, includes an array of one or more microphones arranged in a predetermined pattern for capturing sounds. This self-descriptive microphone array operates to solve the problems identified above by providing a microphone array memory that is integral to the microphone array. The microphone array memory includes any type of conventional non-volatile memory, such as, for example a ROM, PROM, EPROM, EEPROM, or other conventional memory type or device, which contains a microphone array device description. This device description includes parametric information that defines operational characteristics and configuration of the self-descriptive microphone array. In operation, the device description of the self-descriptive microphone array is then automatically reported to an external computing device via a microphone array interface to allow for automatic configuration of audio processing software residing within the external computing device for processing audio signals either captured by the self-descriptive microphone array, or in one embodiment, audio signals that are to be played back by one or more speakers residing within the self-descriptive microphone array.

2.1 System Overview:

As noted above, the microphone array device description is automatically provided to an external computing device, such as a PC-type computer, or other computing device to which the microphone array is connected. The external computing device then uses the device description to automatically configure audio processing software for processing one or more audio signals captured by the self-descriptive microphone array. Specifically, software drivers on the external computing device, such as DLL's or other software drivers, interpret physical parameters of the self-descriptive microphone array that are provided by the microphone array device description. These software drivers then communicate the physical parameter data of the self-descriptive microphone array to signal processing software residing within the external computing device. This allows the signal processing software to automatically adjust its parameters to the characteristics of the attached microphone array to perform automatically optimized audio processing computations.

Consequently, because the self-descriptive microphone array makes use of external computing power, rather than including onboard audio processing hardware and software, the self-descriptive microphone array is relatively inexpensive to manufacture in comparison to conventional microphone array devices that include onboard audio processing capabilities. Further, because external processing power is used for audio processing, combined applications such as, for example, adaptive beamforming combined with acoustic echo cancellation (AEC) can be easily performed without including expensive audio processing software and/or hardware within the array itself. Consequently, one major advantage of moving microphone array audio processing to an external computing device is that it enables conventional conferencing applications, applications, such as, for example Microsoft® Windows® Messenger, or other real-time messaging application, to use microphone arrays such as the self-descriptive microphone array described herein while significantly reducing microphone array costs.

The connection between the self-descriptive microphone array and the external computing device is accomplished using any of a variety of conventional wired or wireless computer interfaces, including, for example, serial, IEEE 1394, USB, IEEE 802.11, Bluetooth™, etc., to connect to the external computing device. As noted above, once connected, the self-descriptive microphone array provides its device description to the computing device which then automatically configures audio processing software residing within the computing device for optimally processing one or more analog or digital audio signals provided by the self-descriptive microphone array.

Further, as is well known to those skilled in the art, individual microphone operational characteristics, as well as the characteristics of most other electrical components, tend to change over time, and as a function of local temperature. Consequently, in one embodiment, the self-descriptive microphone array includes an integral self-calibration system for automatically determining or evaluating at least some of the operational parameters of the microphones comprising the self-descriptive microphone array. The microphone array device description within the microphone array memory is then automatically updated to reflect actual configuration of particular elements of the self-descriptive microphone array.

As noted above, preamplifiers are associated with each microphone in the self-descriptive microphone array. Further, to allow for multiple simultaneous channels of audio to be captured by the self-descriptive microphone array, analog-to-digital (A/D) converters are also associated with each microphone. Audio signals captured by the microphone array are then pre-amplified (i.e., gain) and converted to a digital signal via the A/D converters and provided, via the aforementioned wired or wireless computer interface, to the audio processing software residing within the external computing device for further processing, as desired. The maximum number of digital audio channels that can then be transmitted via the computer interface is then only limited by the maximum bandwidth of that computer interface in combination with the digital sampling rate of each channel of the microphone array.

In this embodiment, the integral self-calibration system is capable of automatically determining one or more of the sensitivity and gain (i.e., magnitude and phase gains) of the individual channels (microphone plus preamplifier) in the self-descriptive microphone array. In alternate embodiments, the integral self-calibration system of the self-descriptive microphone array operates automatically either upon connection to the computing device, upon regular or user-specified intervals, or upon command. One advantage of this embodiment is that because exact parameters (i.e., impulse response) of components such as microphones and preamplifiers are determined automatically via self-calibration, there is no need for using closely matched, and thus relatively expensive, sets of microphones and preamplifiers. Any differences in impulse response between individual microphone/preamplifier combinations are simply reported to the external computing device for automatically configuring the audio processing software to optimally respond to the various properties of individual microphone/preamplifier combinations within the self-descriptive microphone array.

In another embodiment, in addition to including one or more microphones, the self-descriptive microphone array also includes one or more speakers for reproducing one or more audio signals. For example, many microphone arrays, such as those arrays used for audio conferencing, frequently include both microphones and speakers. The microphones capture sound, and the speakers play back sound. Generally, conventional audio conferencing-type microphone arrays also include relatively expensive onboard acoustic echo cancellation capabilities so that local audio signals are not endlessly echoed during an audio conference. However, in the context of the self-descriptive microphone array, audio processing, such as acoustic echo cancellation, is performed via the audio processing software residing within the external computing device. Audio to be played back via the self-descriptive microphone array is then simply transmitted from the external computing device to the array via the aforementioned wired or wireless computer interface.

As with the parametric information defining the microphones within the self-descriptive microphone array, parametric information defining the speakers within the self-descriptive microphone array is also stored within the microphone array memory. Configuration of the microphones and the speakers within the microphone array are then reported, as noted above, to allow for automatic configuration of the audio processing software residing within the external computing device to which the self-descriptive microphone array is connected.

Figure 2:
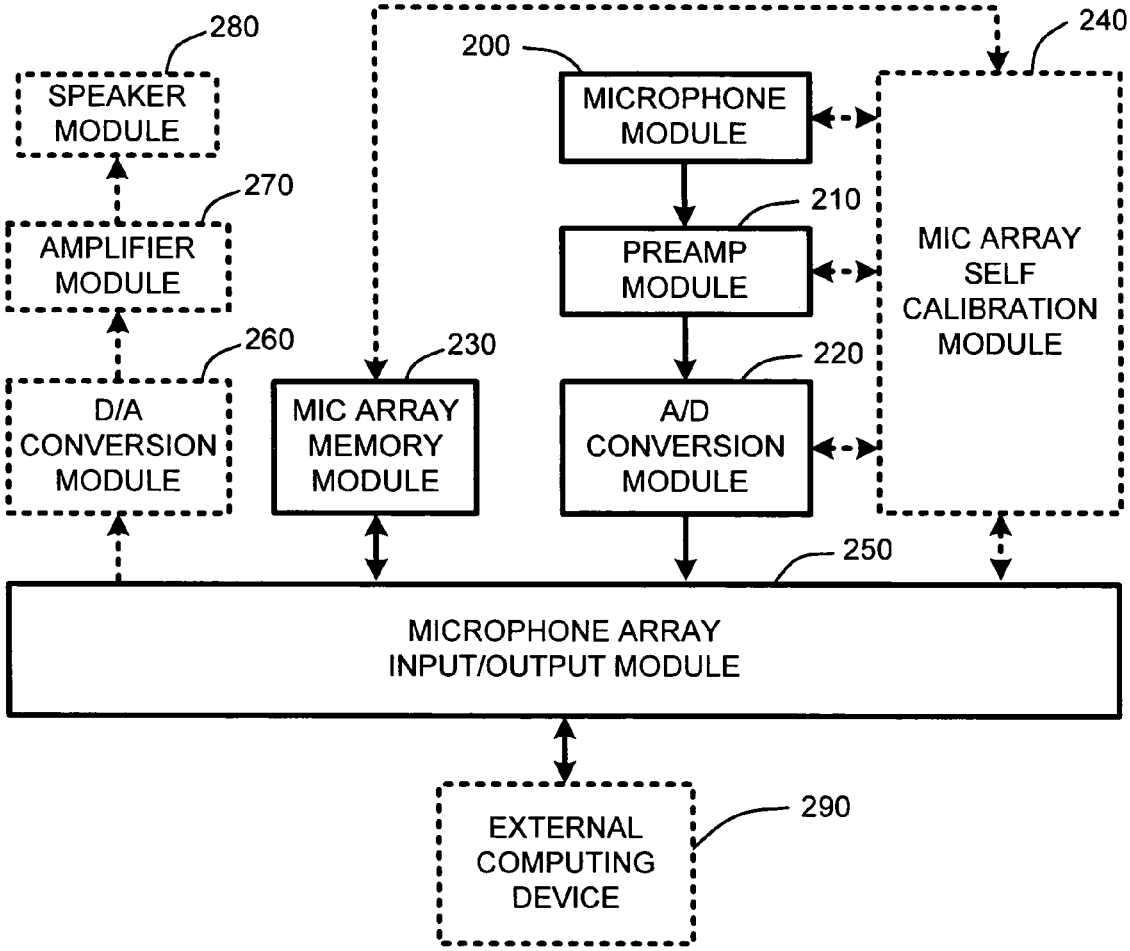
FIG. 2 illustrates an exemplary system diagram showing exemplary hardware and software modules for implementing a self-descriptive microphone array.

2.2 System Architecture:

The processes summarized above are illustrated by the general system diagram of FIG. 2. In particular, the system diagram of FIG. 2 illustrates the interrelationships between hardware and software modules for implementing a self-descriptive microphone array. It should be noted that any boxes and interconnections between boxes that are represented by broken or dashed lines in FIG. 2 represent alternate embodiments of the self-descriptive microphone array described herein, and that any or all of these alternate embodiments, as described below, may be used in combination with other alternate embodiments that are described throughout this document.

In general, the self-descriptive microphone array includes a microphone module 200 comprising one or more microphones, such as, for example, conventional electret microphones, along with circuitry for amplifying analog audio signals captured by the microphone module 200, and for converting the analog signals to a digital format. In particular, amplification of captured signals is provided by a preamp module 210 comprising one or more preamplifier circuits which provide gain for amplifying the captured audio signals. An A/D conversion module 220 then provides one or more A/D converters for converting analog signals captured by the microphones into digital signals for transmission to an external computing device 290 via a microphone array input/output module 250, which provides for conventional data transmission via one of the aforementioned wired or wireless computer interfaces. As described below, parametric information relating to the gain provided by the preamp module 210 is included along with the information stored in a microphone array memory module 230.

Further, in one embodiment, the microphone module 200, preamp module 210, and A/D conversion module 220, are combined into one module (not shown) in the case of microphones such as a MEMS microphone. For example, as is well known to those skilled in the art, a Micro-Electro-Mechanical-Structure (MEMS) type microphone is basically an integrated circuit, typically very small in size, which includes a microphone and preamplifier, and in some cases, A/D conversion within a single circuit or microchip. The use of MEMS-type microphones in the self-descriptive microphone array described herein allows for a further reduction in components by using an integrated circuit which combines each of the preamp module 210, A/D conversion module 220, and microphone module 200 into one module which then provides the operational capability of the three separate modules. Consequently, because the same functionality is provided by a MEMS-type microphone as is provided by use of the separate modules, i.e., the microphone module 200, preamp module 210, and A/D conversion module 220, the self descriptive microphone array will be described in the context of these three modules. However, it should be understood that the use of MEMS-type microphone technology is inherent in the description of these three modules.

As noted above, the self-descriptive microphone array includes the microphone array memory module 230 for storing and reporting parametric information which defines operational characteristics and configuration of the self-descriptive microphone array. In general, the memory module 230 uses any type of conventional non-volatile memory or storage, such as, for example, ROM, PROM, EPROM, EEPROM, etc. The parametric information stored within the memory module 230 is reported to an external computing device 290, either upon connection of the self-descriptive microphone array to the external computing device, or upon a manual or automatic request for the information originating with the external computing device. As described herein, reporting of this parametric information allows for automatic configuration of audio processing software residing within the external computing device 290 for processing audio signals either captured by the self-descriptive microphone array, or in one embodiment, audio signals that are to be played back by one or more speakers residing within the self-descriptive microphone array.

In one embodiment, the parametric information stored in the microphone array memory module 230 is maintained in a lookup table which includes parametric information describing the configuration of the self-descriptive microphone array. In general, this lookup table, or other means of storage, includes one or more of the following elements of parametric information: 1) microphone array manufacturer, model, and version; 2) microphone types and position; 3) microphone array working volume (i.e., where the sound source is expected to be); 4) microphone gain calibration (inexpensive microphones and preamplifier combinations can have a +/−4 dB gain difference due to manufacturing variance); and 5) speaker configuration for any speakers included in microphone array.

As noted above, one embodiment of the self-descriptive microphone array includes self-calibration capabilities. These self-calibration capabilities are provided via a microphone array self-calibration module 240. This microphone array self-calibration module 240 automatically determines a current state of one or more of the components of the microphone array. This current state is then used to automatically update the parametric information stored in the microphone array memory module 230. Note that the microphone array self-calibration module 240 is discussed in further detail below in Section 3.

Further, also as noted above, one embodiment of the self-descriptive microphone array includes a set of one or more speakers. This embodiment also includes one or more digital-to-analog (D/A) converters and one or more amplifiers. In particular, in this embodiment, a D/A conversion module 260 provides one or more D/A converters for performing digital-to-analog conversion of one or more digital signals provided by the external computing device 290 via the microphone array input/output module 250. An amplifier module 270 then provides amplification of the converted analog signals. These analog signals are then provided to a speaker module 280 for playback. In particular, the speaker module 280 includes one or more speakers for reproducing the amplified analog audio signals. Again, in this embodiment, the microphone array memory module 230 further includes parametric information defining physical characteristics of the speakers within the self-descriptive microphone array.

3.0 Operation Overview:

The above-described hardware and software modules are employed for implementing the self descriptive microphone array. As summarized above, this self-descriptive microphone array provides automatic reporting of physical parameters defining components of the microphone array to an external computing device. Automatic reporting of these physical parameters then allows automatic configuration and optimization of audio processing software residing within the external computing device. The following sections provide a detailed discussion of the architecture (FIG. 3) and operation (FIG. 4) of the self-descriptive microphone array, and of exemplary methods for implementing the hardware and software modules described in Section 2.

Figure 3:
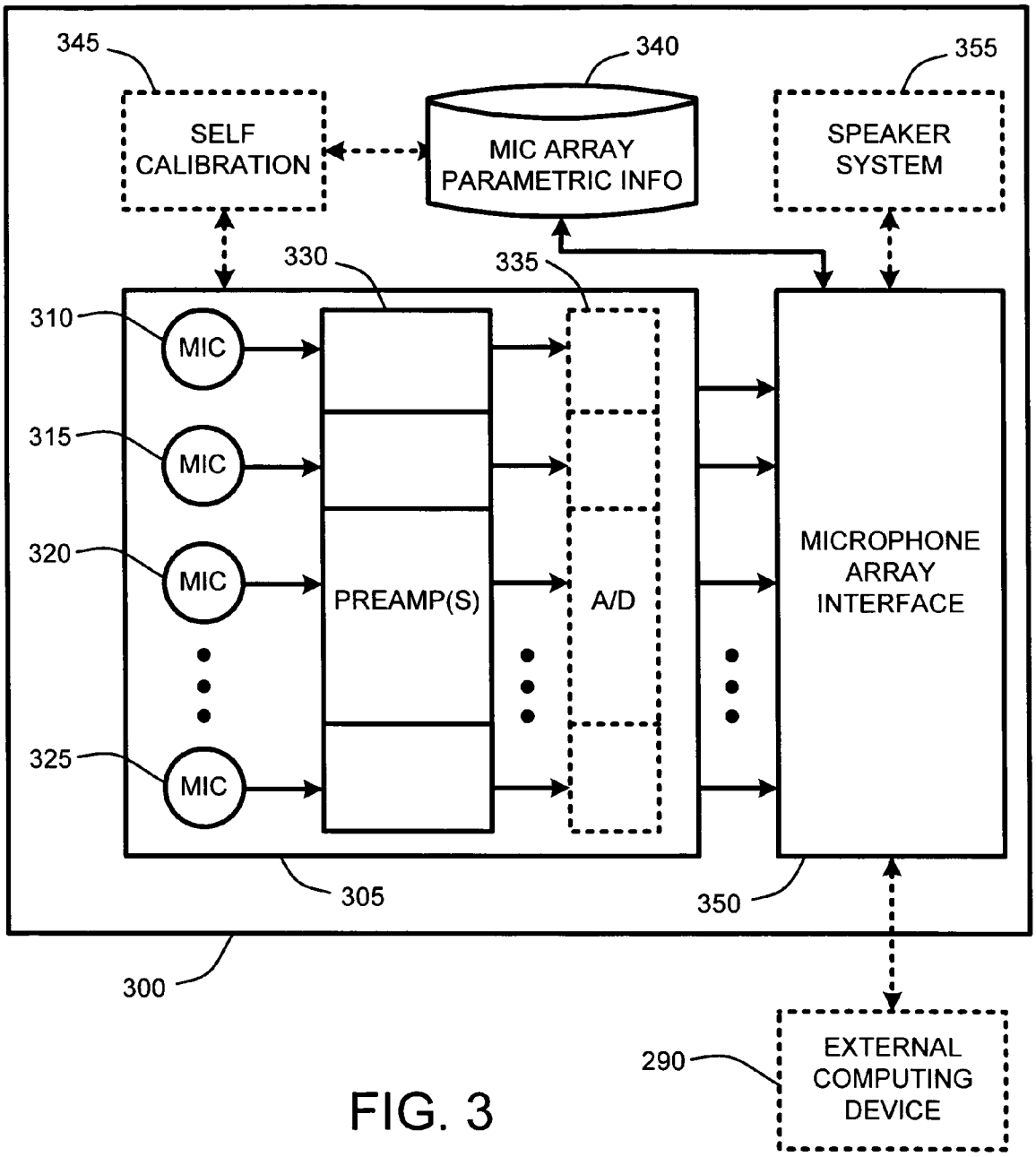
FIG. 3 illustrates an exemplary architectural layout of a hardware system embodying a self-descriptive microphone array.
Figure 4:
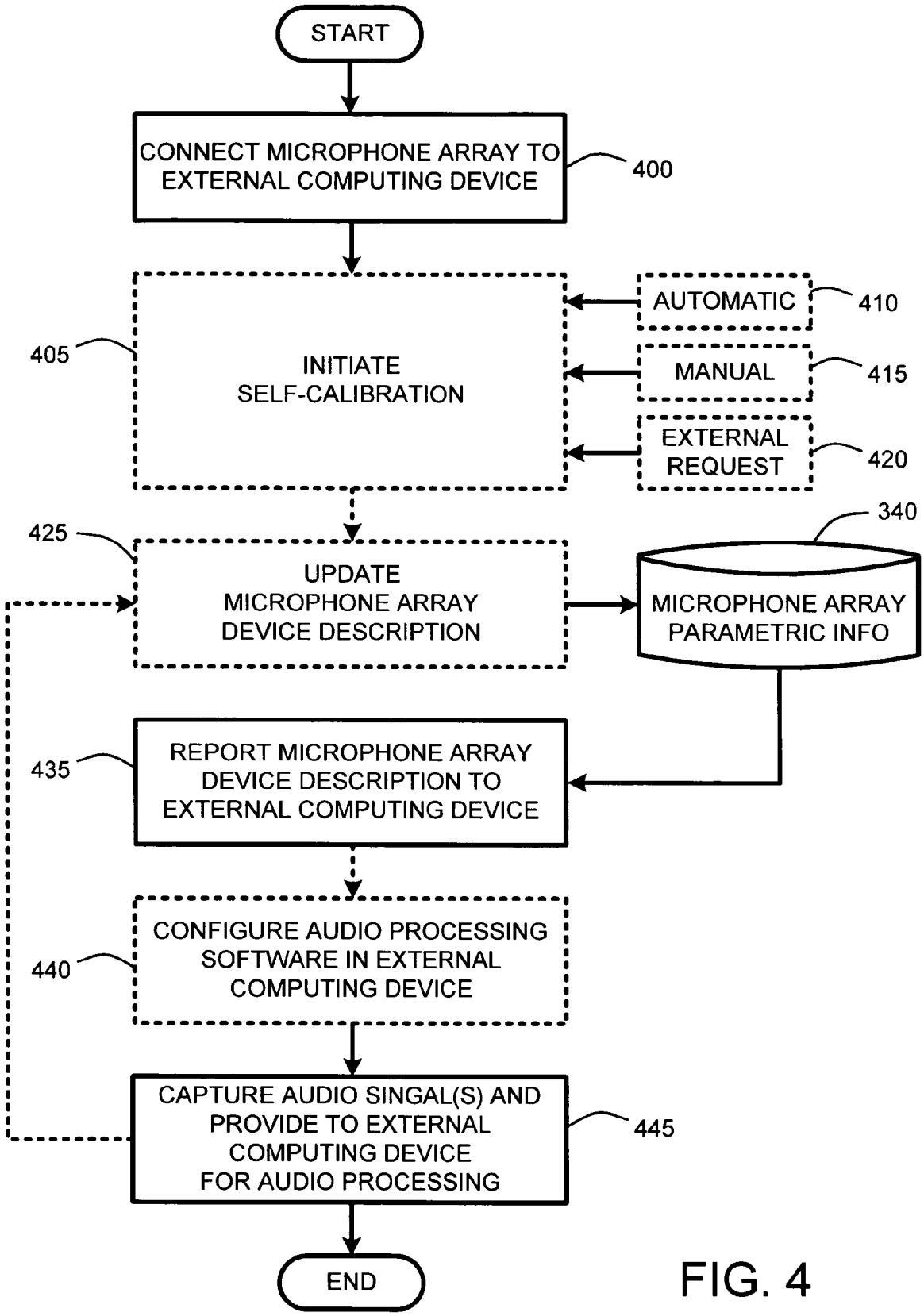
FIG. 4 provides an exemplary operational flow diagram for illustrating the operation of a self-descriptive microphone array.

It should be noted that any boxes and interconnections between boxes that are represented by broken or dashed lines in either FIG. 3 or FIG. 4 represent alternate embodiments of the self-descriptive microphone array described herein, and that any or all of these alternate embodiments, as described below, may be used in combination with other alternate embodiments that are described throughout this document.

3.1 Microphone Array Architecture:

The processes described above with respect to FIG. 2 are illustrated by the general architectural diagram of FIG. 3. In particular, FIG. 3 illustrates an exemplary architectural layout of hardware embodying the microphone array. For example, as illustrated by FIG. 3, a self-descriptive microphone array 300 comprises an array 305 of one or more microphones (310 through 325), a microphone array memory 340 which contains parametric information that defines operational characteristics and configuration of the self-descriptive microphone array, and at least one external interface 350, including, for example, serial, IEEE 1394, USB, IEEE 802.11, Bluetooth™, etc., for connecting the self-descriptive microphone array to an external computing device 290.

Further, the array 305 of microphones included in the self-descriptive microphone array 300 includes one or more preamplifiers 330 for providing gain or preamplification of each microphone (310 through 325). In a related embodiment, the array 305 further includes one or more Analog-to-Digital (A/D) converters 335 for digitizing an analog audio input from each microphone (310 through 325). Note that both preamplifiers and A/D converters are well known and understood by those skilled in the art, and will not be described in detail herein.

In another embodiment, the self-descriptive microphone array 300 includes a self calibration system 345 which automatically determines a current state of one or more of the components of the microphone array. This current state is then used to automatically update one or more of the operational characteristics stored in the microphone array memory 340. For example, in one embodiment, the self calibration system 345 automatically determines preamplifier 330 impulse responses. In general, this determination is made by providing a "pulse injection circuit" for injecting a precise low-amplitude analog pulse at the input of the preamplifier 330. The precise impulse response of the preamplifier 330 is then measured for computing frequency-domain compensation gains for each preamplifier which serve to provide a consistent output from each amplifier regardless of the operational characteristics of each microphone/preamplifier combination. Repeating this process for each preamplifier and storing the resulting preamplifier 330 frequency-domain compensation gains in the microphone array memory 340 allows for precise configuration of audio processing software residing on the external computing device 290 using the frequency-domain compensation gains for each preamplifier.

One clear advantage of this embodiment is that by knowing a precise frequency-domain compensation gain for each preamplifier 330, software drivers associated with audio processing software residing on the external computing device 290 can then easily compensate for phase response mismatches across all preamplifiers. Without compensation, such mismatches would reduce the performance of certain audio processing applications. For example, the performance of conventional beamforming or sound source localization (SSL) digital signal processing software, which combines all microphone signals to provide a relatively narrow capture direction selectivity, will be significantly improved by compensating for the precise phase response of each preamplifier 330. Note that the self calibration system 345 for the self-descriptive microphone array 300 is described in further detail in a copending patent application entitled "ANALOG PREAMPLIFIER MEASUREMENT FOR A MICROPHONE ARRAY," having a filing date of Feb. 4, 2004, and assigned application Ser. No. 10/772,528, the subject matter of which is incorporated herein by this reference.

Finally, in yet another embodiment, the self-descriptive microphone array 300 includes a speaker system 355. In general, this speaker system 355 includes one or more speakers, one or more D/A converters, and one or more amplifiers for amplifying analog audio signals prior to playback by the speakers included in the speaker system. In this embodiment, audio signals provided by the external computing device 290 via the microphone array interface 350 are first converted to analog signals, amplified, and then reproduced by providing the amplified analog audio signals to the speakers of the speaker system 355.

3.2 Microphone Array Operation:

In general, as illustrated by FIG. 4, the self-descriptive microphone array described above operates by first connecting the self-descriptive microphone array to the external computing device (Box 400). As noted above, this connection is accomplished using a conventional wired or wireless computer interface, such as, for example, serial, parallel, IEEE 1394, USB, IEEE 802.11, Bluetooth™, etc., for connecting the self-descriptive microphone array to the external computing device.

In one embodiment, once connected, self-calibration of the self-descriptive microphone array is initiated. In a tested embodiment, this self-calibration is performed automatically (Box 410) as soon as the self-descriptive microphone array is connected to the external computing device (Box 400). In a related embodiment, the self-calibration is performed immediately upon manual user request (Box 415), said request being provided from the external computing device via the computer interface. In another related embodiment, the self-calibration is performed immediately upon an external request (Box 420), such as, for example, a request generated by one an audio processing software program operating on the external computing device. Again, as with the manual request (Box 415), the external request (Box 420) is provided from the external computing device via the computer interface. In each of these embodiments, i.e., automatic, manual, or externally requested self-calibration, the microphone array device description automatically updates (Box 425) the microphone array parametric information 340 to reflect the current state of the microphone array as determined via the above-described self-calibration procedure.

At this point, the parametric information 340 defining the current state of the self-descriptive microphone array is reported (Box 435) to the external computing device. As noted above, given the known operational characteristics of the components of the self-descriptive microphone array (i.e., microphone, speakers, preamps, etc.), audio processing software operating within the external computing device is automatically optimized and/or configured (Box 440) to provide a computing environment that is specifically tailored to the known parameters of the self-descriptive microphone array connected to the external computing device.

For example, assuming a microphone array with two microphones, where one of the microphone channels has a gain of +4 dB more than the other microphone channel, the input received by either of the microphones is then weighted by a factor designed to compensate for the difference in gain so that the input provided by either of the microphones will be nominally equivalent. As a result of such adjustments, conventional processing of audio captured by the self-descriptive microphone array is significantly improved relative to audio processing without weighting the audio inputs to reflect actual microphone array configurations.

Once the audio processing software has been optimally configured, one or more audio signals are captured by the self-descriptive microphone array and provided to the external computing device, via the aforementioned computer interface, for audio processing, as desired (Box 445). Such processing may include, for example, conventional sound source localization, beam forming, acoustic echo cancellation, noise suppression, etc. Note that as such audio processing techniques are well known to those skilled in the art, they will not be described in detail herein. Finally, in one embodiment, the device description including the microphone array parametric information 340 is updated at any time during the above-described processes by requesting a self-calibration, either manually, or via an external request, as described above.

However, it should be noted that it is not necessary to update all of the parametric information 340 as a part of the self-calibration. For example, certain parameters may be set, with no need for further updates, during manufacturing of the self-descriptive microphone array. For example, information such as the manufacturer name, microphone positions, harmonic distortion of microphones or speakers, etc., may be included in the parametric information at the time of manufacture, without the need to subsequently update such values. Other parameters, such as, for example, microphone gain, may be updated during the self-calibration.

3.2.1 Microphone Array Lookup Table:

As noted above, a tested embodiment of the microphone array parametric information 340 is implemented as a lookup table using an EEPROM. An EEPROM or similar rewritable addressable memory is used in this embodiment to allow for updating of the lookup table, either in response to microphone array self-calibration, or in response to user adjustment of lookup table parameters from the external computing device via the microphone array interface.

As noted above, this lookup table generally includes one or more of 1) microphone array manufacturer, model, and version; 2) microphone types and position; 3) microphone array working volume (i.e., where the sound source is expected to be); 4) microphone gain calibration (note that nominally identical microphones can have on the order of a +/−4 dB gain difference due to manufacturing variances); and 5) speaker configuration for any speakers included in microphone array. Clearly, additional information may be included in the lookup table if it is available. For example, additional parametric information that may be useful for configuring particular audio processing software includes response functions for the microphones in the array; response functions for any speakers in the array; wave coefficient tables for each microphone or speaker, etc. When available, such information is included in the lookup table, and reported to the external computing device as described above.

For example, in a tested embodiment, the parametric information stored in the microphone array parametric information 340 includes parametric information such as, for example, the type of microphone array, e.g., linear, planar, three-dimensional, etc. Further, the parametric information stored in the microphone array parametric information 340 includes number and geometry information regarding microphones in the array, including the number of microphones in the array; a working volume of each microphone in the array, e.g., the working elevation and azimuth for audio reception; the type of each microphone, e.g., omnidirectional, subcardiod, cardiod, supercardiod, hypercardiod, etc., positional information for each microphone in the array, e.g., and the physical location and orientation of each microphone in a three dimensional space of the array.

In addition, the parametric information stored in the microphone array parametric information 340 also includes any gain associated with each microphone in the array. As noted above, in this tested embodiment, the parametric information stored in the microphone array parametric information 340 also includes information describing any speakers included in the self-descriptive microphone array. Finally, in one embodiment, additional parametric information including a manufacturer name, a microphone array model number, and a microphone array version or revision number, were also included within the parametric information stored the lookup table representing the microphone array parametric information 340.

In further embodiments, additional information is included in the table to address particular microphone or microphone array types, parameters, and capabilities. For example, additional information that may be incorporated into the table includes, but is not limited to: microphone and speaker latencies (time it takes the PC to send/receive sound), including sampling latencies between microphones; phase difference between A/D and D/A conversions for the microphone and speakers respectively; frequency response for microphones and speakers; harmonic distortion for microphones and speakers; directivity pattern of microphones in a particular microphone array; terminal coupling loss for defining how well the microphones pick up the speaker or speakers in the array; and maximum speaker level.

The table described in the preceding paragraphs is represented by TABLE 1, which illustrates one example of the lookup table described above as used in a tested embodiment of the self-descriptive microphone array. It should be appreciated that any desired information may be included in such tables, and that TABLE 1 is provided only for purposes of illustration and that the content of this exemplary table is not intended to limit the scope of the information included in such tables.

TABLE 1

Example of a Parametric Information Lookup Table for the Self-Descriptive Microphone Array.

| Field | Description |
|---|---|
| | Note that the following table entries are used to define manufacturer related information of the self-descriptive microphone array. |
| Manufacturer | Manufacturer string |
| Model | Model string |
| Version | Version string |
| | Note that the following table entries are used to provide a general description of the configuration of self-descriptive microphone array. |
| Array_Type | Array type: 0 = linear, 1 = planar, 2 = 3D, etc. |
| Num_Mic | Number of microphones |
| Array_Directivity | Directivity pattern of microphones within the self-descriptive microphone array |
| Phase_Difference | Phase difference between A/D and D/A conversion |
| | Note that the following table entries are used to describe the working volume of the microphone array |
| Elevation_Min | Minimum working volume elevation in degrees |
| Elevation_Max | Maximum working volume elevation in degrees |
| Azimuth_Min | Minimum working volume azimuth in degrees |
| Azimuth_Max | Maximum working volume azimuth in degrees |
| | Note that the following table entries are repeated for each microphone in the self- descriptive microphone array. |
| Mic_Type | Microphone type; the three MSB of this entry define type as follows: 0 = omnidirectional, 1 = subcardioid, 2 = cardiod, 3 = supercardioid, 4 = hypercardiod; other custom values possible. Remaining LSB determine the particular microphone: 0 - generic type, other numbers are assigned to specific microphone/manufacturer combinations. |
| Mic_X_Axis | Microphone X-axis location within the microphone array |

TABLE 1-continued

Example of a Parametric Information Lookup Table for the Self-Descriptive Microphone Array.

| Field | Description |
|---|---|
| Mic_Y_Axis | Microphone Y-axis location within the microphone array |
| Mic_Z_Axis | Microphone Z-axis location within the microphone array |
| Mic_Elevation | Microphone orientation in degrees |
| Mic_Azimuth | Microphone orientation in degrees |
| Mic_Gain | Microphone gain * 1000 |
| Mic_Latency | Microphone latency, i.e., the time it takes the external computing device to receive audio signals, including sampling latencies between microphones |
| Mic_Freq_Resp | Frequency response of the microphone |
| MIC_Harmonic | Harmonic distortion of the microphone |
| Mic_Coupling | Terminal coupling loss of the microphone, i.e., how well the microphone picks up the speaker |
| | Note that the following table entries are repeated for each speaker in the self-descriptive microphone array. |
| Num_Speakers | Number of speakers |
| Speaker_Type | Designates speaker directivity and frequency response |
| Speaker_X_Axis | Speaker X-axis location within the microphone array |
| Speaker_Y_Axis | Speaker Y-axis location within the microphone array |
| Speaker_Z_Axis | Speaker Z-axis location within the microphone array |
| Speaker_Elevation | Speaker orientation in degrees |
| Speaker_Azimuth | Speaker orientation in degrees |
| Speaker_Latency | Speaker latency, i.e., the time it takes the external computing device to send audio signals to speakers in microphone array |
| Speaker_Max_Level | Maximum speaker level, e.g., dB sound pressure level (SPL) at 1 meter. |
| Speaker_Freq_Resp | Frequency response of the microphone |
| Speaker_Harmonic | Harmonic distortion of the microphone |

The foregoing description of the self-descriptive microphone array has been presented for the purposes of illustration and description. It is not intended to be exhaustive or to limit the invention to the precise form disclosed. Many modifications and variations are possible in light of the above teaching. Further, it should be noted that any or all of the aforementioned alternate embodiments may be used in any combination desired to form additional hybrid embodiments of the self-descriptive microphone array. It is intended that the scope of the invention be limited not by this detailed description, but rather by the claims appended hereto.

What is claimed is:

1. A microphone array, comprising:

an array of at least one microphone;

a memory contained within the array, said memory including parametric information which defines operational characteristics and configuration of the array;

an array interface for connecting the array to an external computing device;

wherein the parametric information included in the memory is reported to the external computing device via the array interface upon connection of the array to the external computing device; and wherein audio signals captured by the microphone array are transmitted from the microphone array to the external computing device via the array interface, said external computing device performing all audio processing of the captured audio signals in accordance with the parametric information reported to the external computing device.

2. The microphone array of claim 1 wherein the memory is a rewritable-type memory.

3. The microphone array of claim 2 wherein the array further comprises a self-calibration system for automatically evaluating the parametric information which defines operational characteristics and configuration of the microphone array.

4. The microphone array of claim 3 wherein the parametric information is automatically updated to reflect a current configuration state of the array as identified by automatically evaluating the parametric information which defines operational characteristics and configuration of the microphone array.

5. The microphone array of claim 3 wherein each microphone in the array further includes an associated preamplifier, and wherein the self-calibration system automatically determines gain of each microphone and associated preamplifier in the microphone array.

6. The microphone array of claim 1 further comprising a set of at least one speaker, and wherein parametric information which defines operational characteristics and configuration of each speaker is included in the memory contained within the microphone array.

7. The microphone array of claim 1 wherein the parametric information included within the memory contained within the microphone array includes information defining audio capture characteristics of the microphone array.

8. The microphone array of claim 1 wherein the array interface for connecting the microphone array to the external computing device is any of a wired and a wireless computer interface.

9. The microphone array of claim 1 further comprising one or more preamplifiers and one or more analog-to-digital (A/D) converters, said preamplifiers being used to preamplify analog signals captured by each microphone in the array, and said A/D converters being used to convert each preamplified analog audio signal to create a digital audio signal from each analog audio signal.

10. The microphone array of claim 3 wherein the self calibration system operates automatically for evaluating the parametric information which defines operational characteristics and configuration of the array as soon as the array is connected to the external computing device via the array interface.

11. The microphone array of claim 3 wherein the self calibration system operates automatically for evaluating the parametric information which defines operational characteristics and configuration of the array upon a user calibration request transmitted to the microphone array from the external computing device via the array interface.

12. The microphone array of claim 3 wherein the self calibration system operates automatically for evaluating the parametric information which defines operational characteristics and configuration of the array upon an external calibration request transmitted to the microphone array from the external computing device via the array interface, said external calibration request being generated by audio processing software residing within the external computing device.

13. The microphone array of claim 1 wherein one or more of the microphones comprising the array of at least one microphone are MEMS-type microphones.

14. A method for automatically adapting audio processing software for optimally processing audio signals captured by a microphone array, comprising using a computing device to:

automatically configure audio processing software operating within an external computing device to reflect a current configuration of a microphone array;

wherein the automatically configured audio processing software operating within the external computing device is used for processing audio signals captured by the microphone array and transmitted to the external computing device;

said microphone array including at least one microphone, and said microphone array being coupled to the external computing device via any of a wired and a wireless computer interface;

wherein the microphone array automatically determines the current configuration upon being coupled to the external computing device via the computer interface; and wherein the microphone array automatically reports the current configuration to the external computing device via the computer interface after the microphone array automatically determines the current configuration.

15. The method of claim 14 wherein automatically determining the current configuration comprises automatically determining magnitude and phase gains for each microphone in the microphone array.

16. The method of claim 14 wherein the current configuration of the microphone array is stored locally within the microphone array within a microphone array memory.

17. The method of claim 16 wherein the microphone array memory is a programmable memory, and wherein the current configuration is stored within the programmable memory in an addressable lookup table.

18. The method of claim 17 wherein the current configuration stored within the addressable lookup table includes information defining audio capture characteristics for each microphone in the microphone array.

19. The method of claim 14 wherein the microphone array further provides a separate audio signal for each microphone in the microphone array to the external computing device via the computer interface.

20. The method of claim 19 wherein each separate audio signal provided to the external computing device is a digital audio signal, and wherein the microphone array includes one or more preamplifiers and one or more analog-to-digital (A/D) converters, said preamplifiers being used to preamplify analog signals captured by each microphone in the microphone array, and said A/D converters being used to convert each preamplified analog audio signal to create each digital audio signal.

21. The method of claim 14 wherein the microphone array automatically determines the current configuration upon a manual user calibration request transmitted to the microphone array from the external computing device via the computer interface.

22. The method of claim 14 wherein the microphone array automatically determines the current configuration upon an external calibration request transmitted to the microphone array from the external computing device via the computer interface, said external calibration request being generated by the audio processing software operating within the external computing device.

23. The method of claim 14 wherein at least one of the microphones included in the microphone array are MEMS microphones, each said MEMS microphone comprising an integrated circuit including one or more microphones, preamplifiers and A/D converters.

24. A system for automatically providing device configuration information of a microphone array to an external computing device, comprising:

a microphone array including at least one microphone, each microphone having a predetermined position in a three-dimensional space relative to the microphone array;

said microphone array further including at least one addressable memory, said addressable memory storing parametric information detailing device configuration information of the microphone array;

wherein the microphone array automatically reads the parametric information from the addressable memory and reports the parametric information to the external computing device via a computer interface, said external computing device being remotely coupled to the microphone array via the computer interface; and wherein audio signals captured by the microphone array are transmitted from the microphone array to the external computing device via the computer interface, said external computing device performing all audio processing of the captured audio signals in accordance with the parametric information reported to the external computing device.

25. The system of claim 24 wherein the microphone array further includes an automatic self-calibration circuit for automatically determining the parametric information detailing the device configuration information of the microphone array.

26. The system of claim 24 wherein the at least one addressable memory is automatically updated by the microphone array to include the automatically determined parametric information detailing the device configuration information of the microphone array.

27. The system of claim 24 wherein the parametric information stored within the at least one addressable memory includes audio capture characteristics for each microphone in the microphone array.

28. The system of claim 24 wherein the microphone array further includes a set of at least one speaker for reproducing one or more audio signals, and wherein the parametric information detailing the device configuration information of the microphone array further includes audio playback characteristics of each speaker included in the microphone array.

29. The system of claim 24 wherein the computer interface is any of a wired and a wireless computer interface.

30. The system of claim 24 further comprising automatically configuring audio processing software operating within the external computing device to reflect the parametric information reported to the external computing device via the computer interface for optimally processing one or more audio signals acquired by the at least one microphone of the microphone array, said audio signals being provided to the external computing device from the microphone array via the computer interface.

* * * * *